US005524511A

United States Patent [19]

Taka's

[11] Patent Number: 5,524,511

[45] Date of Patent: Jun. 11, 1996

[54] LOCKNUT TOOL

[75] Inventor: Michael Taka's, Wichita Falls, Tex.

[73] Assignee: Takas Tool Company, Inc., Wichita Falls, Tex.

[21] Appl. No.: 261,186

[22] Filed: Jun. 13, 1994

[51] Int. Cl.[6] ..... B25B 13/56

[52] U.S. Cl. ..... 81/176.15; 81/177.9; 81/124.2; 81/900

[58] Field of Search ..... 81/119, 124.2, 81/176.15, 176.2, 177.1, 177.7, 177.9, 900

[56] References Cited

U.S. PATENT DOCUMENTS

| | | | |
|---|---|---|---|
| 2,397,574 | 4/1946 | Thonet | 81/176.15 |
| 2,522,038 | 9/1950 | Houghton | 81/176.15 |
| 2,830,480 | 4/1958 | Brame | 81/176.15 |
| 3,383,962 | 5/1968 | Harris | 81/177.9 |
| 3,768,345 | 10/1973 | Barnes | 81/176.15 |
| 5,259,277 | 11/1993 | Zurbuchen | 81/900 X |

*Primary Examiner*—James G. Smith
*Attorney, Agent, or Firm*—Jerry C. Ray

[57] ABSTRACT

A wrench for turning locknuts has a C-shaped head pivotally attached by an extension member to a handle. A recessed step extends part-way around an interior arc of the head, and has a radius sufficient to receive the overall diameter of a locknut. The recessed step is terminated by a shoulder at the end of each arcuate arm forming the head; the shoulders extend toward the center of the head and have dimensions and spacing to fit into the spaces between lugs on a locknut. A notch has a common distal boundary with the recessed step and provides free play in the fit of the wrench over a locknut. When the wrench is placed over a locknut the shoulders fit between and engage lugs on the locknut for turning.

1 Claim, 2 Drawing Sheets

VIEW I–I

LOCKNUT TOOL

CROSS REFERENCE TO RELATED APPLICATIONS

None; Applicant filed, however, Disclosure Document No. 350828, dated Mar. 25, 1994, which is related to this application; therefore by separate paper it is requested that the document be retained and acknowledgement thereof made by the Examiner.

BACKGROUND OF THE INVENTION

1. Field of the Invention

This invention is related to wrench-type tools, and specifically to wrenches adapted to fit locknuts such as those used on electrical conduit.

2. Description of the Related Art

Locknuts are designed to secure themselves to the surface against which they are tightened; this surface is referred to herein as a "contact surface." Locknuts come in a wide variety of shapes and sizes, and have a number of applications. One widespread use of locknuts is in assembling electrical conduit, especially to join sections of conduit to junction boxes and fittings, and to attach fittings such as wire clamps to junction boxes. Many millions of these locknuts are used annually in the United States. Locknuts for electrical conduit are referred to herein as "electrical locknuts" or simply "locknuts."

Locknuts for electrical conduit are typically annular pieces of soft metal with threads on an inner surface of the ring and with lugs or ears projecting from the perimeter of the ring. The lugs, usually six or eight in number, are twisted slightly relative to the main part of the ring; the twist improves the grip of the lugs against a contact surface such as an electrical junction box. Also, the entire locknut usually has slightly concave shape; the concave side is placed against a surface, again to increase the purchase of the locknut.

Tightening and removing locknuts is generally accomplished by placing the blade of a screwdriver against a lug of the locknut, and rapping on the handle of the screwdriver with hammer, pliers, or some other tool. This method often results in skinned knuckles and damaged tools, while a slipped screwdriver may contact a live circuit and result in possible electrocution or fire. Hence the need for a safe and efficient wrench for tightening and loosening locknuts.

Several tools for locknuts have been patented. Barnes discloses a spanner type drive head similar to a mechanic's socket wrench, with teeth to engage a locknut. Bowles, Vibber, and Young disclose wrenches having a member to fit inside an opening in the conduit and another member or members to engage a locknut. Houghton discloses another socket-type wrench with teeth to engage locknut lugs. Gagne discloses an open-end wrench with two teeth on its head. Hockenberry discloses a spanner wrench with a semi-cylindrical base having notches to fit around the lugs on a locknut. Apparently only the Gagne and Hockenberry tools can be fitted around a piece of conduit and onto a locknut on the conduit; i.e., to a locknut which is not at the end of a section of conduit.

U.S. patents of which Applicant is aware, including those mentioned in the preceding paragraph, are listed below:

| U.S. Pat. No. | Issue Date | Patentee |
|---|---|---|
| 1,633,297 | Jun. 21, 1927 | Vibber |
| 1,752,074 | March 25, 1930 | Gagne |
| 2,233,046 | Feb. 25, 1941 | Bowles |
| 2,522,038 | Sep. 12, 1950 | Houghton |
| 2,575,779 | Nov. 20, 1951 | Young |
| 3,768,345 | Oct. 30, 1973 | Barnes |
| 4,848,195 | Jul. 18, 1989 | Hockenberry |

SUMMARY OF THE INVENTION

Progressive Contribution to the Art

The present invention is a wrench for locknuts with a C-shaped head attached to a handle. The handle includes a shank which is joined by a pivot joint to a member extending from the head. The member extends from the wrench head at an angle to provide clearance between the handle and the surface against which the locknut is being tightened. A detent mechanism is engaged at two or more working positions of the pivoting head. The detent includes a spring-biased pin disposed in a recess in the end of the shank; the pin engages dimples in the member extending from the head. The end of the handle which is grasped is shaped for a comfortable fit, is coated with an insulating material which also serves as a padded grip for the hand. An opening in the C-shaped head is sized to fit over a diameter of the conduit for that particular size of wrench. The engagement side of the head has a step recessed part-way around its interior arcuate surface; the step or recess provides clearance for lugs on the locknut. The step does not extend to the ends of the arcuate arms which form the C-shaped head, but are terminated by a shoulder at the extremity of each arm. The configuration and dimensions of the head are such that a locknut of a particular size will fit within the recessed step while the shoulders engage lugs on the locknut for turning. A notch of the same depth as the recessed step extends across a radius of each arcuate arm adjacent to each shoulder, to give definition to the shoulder and provide a small amount of free play in the fit of the wrench.

OBJECTS OF THIS INVENTION

Based on the above, it is an object of this invention to provide a practical, useful tool for tightening and removing locknuts.

It is a further object of this invention to provide a tool specifically for electrical locknuts, a tool which will allow assembly of electrical conduit with greater efficiency and in greater safety.

It is another object of this invention to provide an electrical locknut tool which will be sized to fit locknuts for particular sizes of conduit, and which will be adapted to fit either 6- or 8-lug locknuts.

Further objects are to achieve the above with devices that are sturdy, compact, durable, lightweight, simple, safe, efficient, versatile, and reliable, yet inexpensive and easy to manufacture and maintain.

The specific nature of the invention, as well as other objects, uses, and advantages thereof, will clearly appear from the following description and from the accompanying drawings, the different views of which are not necessarily scale drawings.

Figure 1:
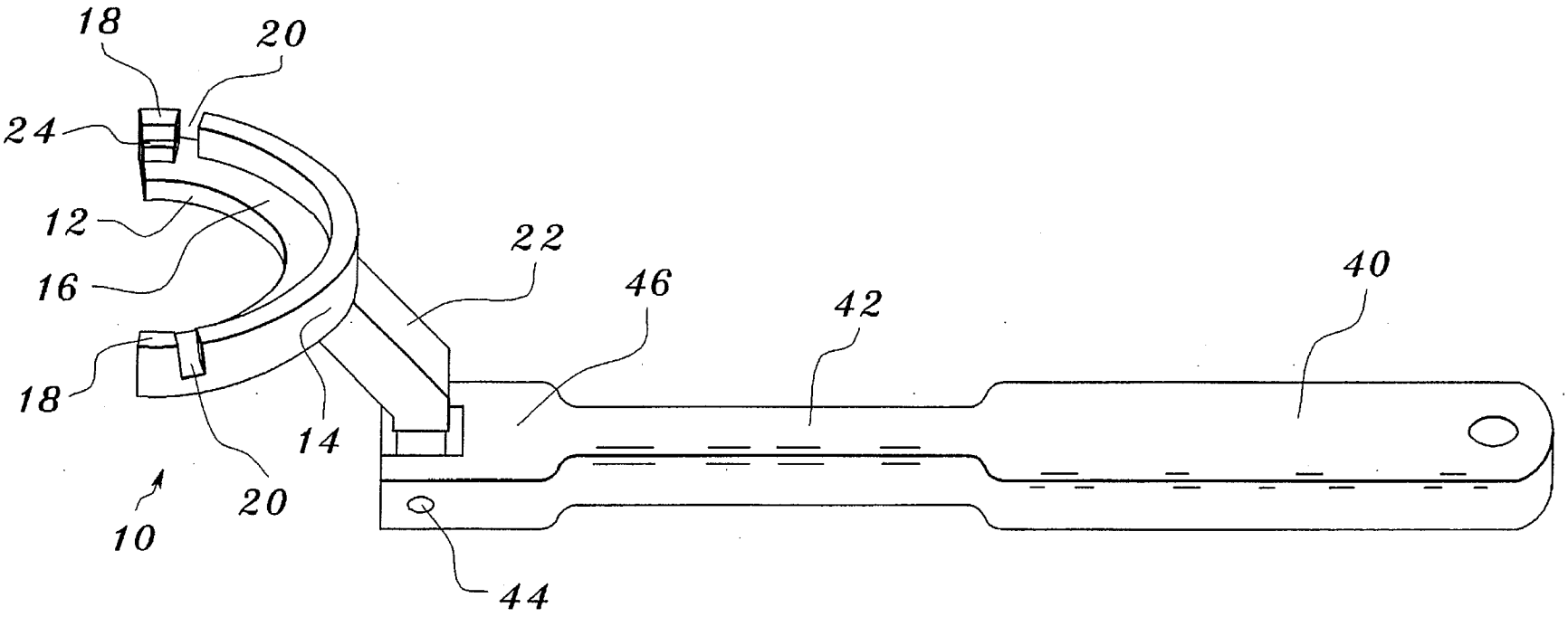
FIG. 1 shows a perspective of the locknut tool.

As an aid to correlating the terms of the claims to the exemplary drawings, the following catalog of elements is provided:

Catalog of the Elements:

10 C-shaped head

12 Arcuate arm

14 Central portion of head

16 Recessed step

18 Shoulder

20 Notch

22 Extended member

24 Shoulder recess

40 Handle

42 Shank

44 Pivot pin

46 Yoke

48 Detent pin

50 Dimple

DESCRIPTION OF THE PREFERRED EMBODIMENTS

As illustrated in FIG. 1, the locknut tool is a wrench having a C-shaped head 10 defined by two arcuate arms 12 extending from an arcuate central portion 14 of the head. The gap in the head which forms the "C" shape has a width to accommodate the diameter of conduit which the wrench fits. In use, the wrench may be slipped over the conduit to engage a locknut on the conduit. It is understood that locknuts and the wrenches to fit them are in a variety of sizes. This description is given in terms of a locknut and tool of a specific and matching size.

Figure 2:
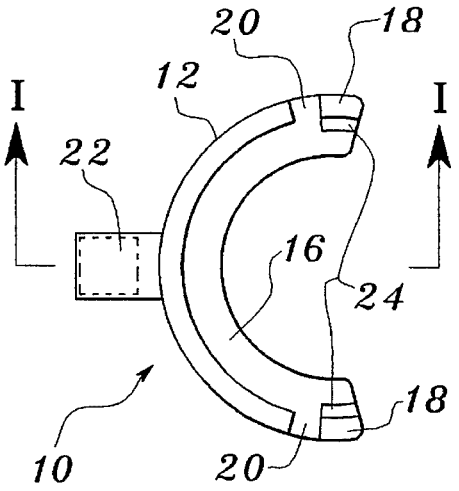
FIG. 2 is a detail of construction of the C-shaped head.

Referring to FIG. 2, one side of the wrench head 10 is configured to engage the lugs on a locknut. Lugs are defined as protrusions from the annular portion of a locknut; they are also known as "ears" or "dog-ears." In the preferred embodiment, the wrench head is made of steel and the working parts of the head are formed by milling. Other materials and methods of forming the engagement or working side of the head may work equally well. In some industrial environments with an explosion hazard it is important to use tools made of non-ferrous materials or other materials which will not strike sparks; considerations such as this affect the choice of materials for the locknut tool.

The wrench head 10 is configured like a ring with a gap cut out to form the C-shape. A radius of the central opening of the head is smaller than an overall radius of a locknut, i.e., a radius including the lugs.

Figure 3:
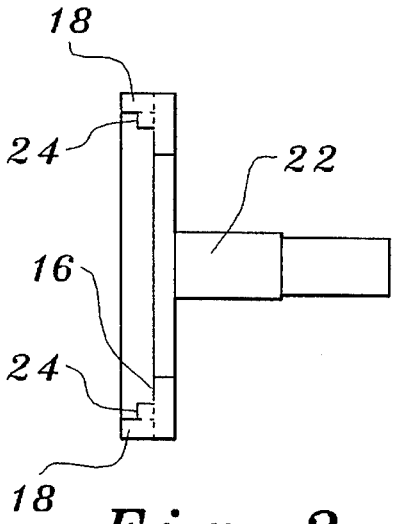
FIG. 3 illustrates the recessed step and shoulder recesses in the C-shaped head.

Referring to FIGS. 2 and 3, a recessed step 16 is formed in an interior arcuate surface of the wrench head 10, and is continuous around the interior curve of the head but does not extend to the ends of the arms 12. An arcuate surface, as used herein, is defined as a surface at right angles to a plane of the wrench head, and which forms an arc of a circle included in the C-shaped head. A radius of the arcuate surface which defines step 16 is slightly larger that the overall radius of a locknut (including the lugs), so that when the wrench is placed over a locknut the locknut will fit within the recessed step.

The termination of the recessed step short of the end of each arcuate arm 12 defines a shoulder 18 on the end of each arm. As used herein, shoulder is defined as an abrupt projection that forms an abutment on an object or limits motion. The inner arcuate surface of each shoulder 18 is set back from the inner arcuate surface of the wrench head. A radius to an inner arcuate surface of each shoulder is less than the overall radius of a locknut, i.e., including the lugs, but greater than a radius of the inner ring of the locknut, not including the lugs. Thus the shoulders 18 extend toward the center of the head a sufficient distance to engage the lugs when the wrench is fitted over a locknut.

Lugs on locknuts often have a tip or short tapered projection extending from their trailing edge, i.e., the edge which will engage the surface against which the locknut is tightened to prevent the locknut from loosening. To accommodate this projecting tip, a recess 24 is cut into the inner arcuate surface of each shoulder 18 of the wrench, into the side of the shoulder proximate the working surface. When the wrench is engaging a locknut, the projecting tip fits into an end of the recess in the shoulder so that the point of the tip does not bear against a surface of the shoulder. Thus surface-to-surface contact between the wrench shoulders and the lugs is maximized, and the effectiveness of the wrench is improved.

The shoulders 18 have an angular separation on the wrench head to match the angular separation of spaces between the lugs on a locknut. In the preferred embodiment, this separation is 180°; other spacings are workable, and where more than two shoulders are used the angular separation is less. The position of the shoulders is such that they fit into the spaces between the lugs of a locknut.

Figure 4:
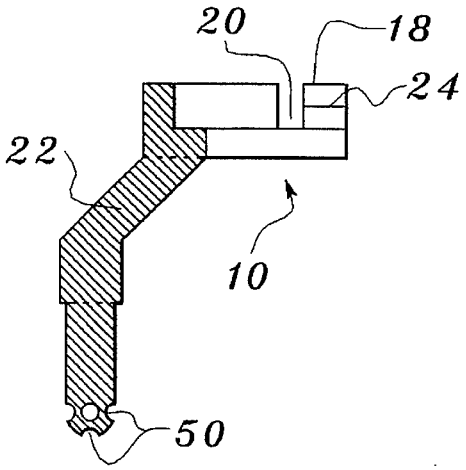
FIG. 4 is a cross section I—I of FIG. 2.

To facilitate using the wrench in close quarters, some free play in the fit of the wrench is provided by a notch 20 adjacent each shoulder 18, illustrated in FIG. 4. The bottom or floor of the notch is on a plane with the floor of the recessed step; i.e., notch and step are of equal depth. When the wrench is engaging a locknut, each notch 20 is opposite a lug of the locknut, allowing a slight lateral movement of the wrench relative to the locknut. Without the notch, the opposing lugs would contact the wall of the recessed step 16, reducing the amount of free play or slack in the fit of the wrench.

Referring to FIG. 2, the front and rear surfaces of each shoulder 18 are parallel to a radius of the arcuate wrench head. These front and rear surfaces on the shoulders contact the locknut lugs, which have corresponding surfaces at the same angle; thus contact of a maximum surface area is ensured. As described above, in the preferred embodiment a relatively shallow recess is cut in the inner arcuate surface of each shoulder 18 to improve the fit of the wrench against the inner ring of the locknut.

An extended member 22 is integral with the central portion 14 of the wrench head 10 and is attached to the wrench handle 40. In the preferred embodiment, a portion of the extended member 22 forms an angle with the plane of the wrench head 10, so that the member angles away from a conduit over which the wrench is fitted. Thus clearance is provided between the conduit and the handle. In addition, the length of the extended member 22 provides clearance between the handle and a surface against which a locknut is being tightened, reducing the likelihood of finger or hand injury.

Figure 5:
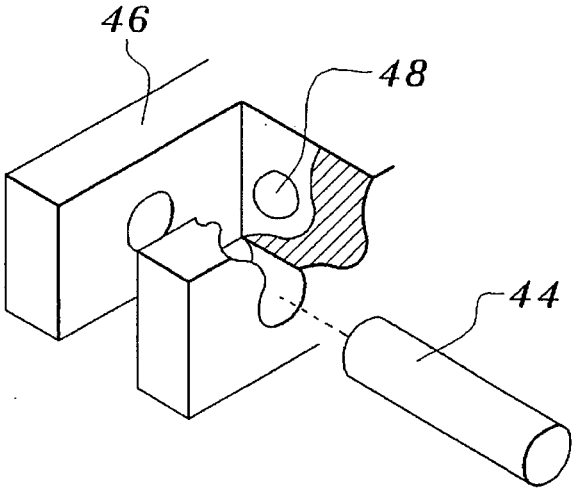
FIG. 5 is a detail of the yoke end of the handle showing the detent pin and pivot pin.

Referring to FIGS. 4 and 5, a pivoting attachment between wrench head 10 and handle 40 allows the head to pivot about an axis perpendicular to a linear axis of the handle. The pivot mechanism comprises a pivot pin 44 through the extended member 22; the end of the shank portion of handle 40 is bifurcated to form yoke 46, with holes in each arm of the yoke to receive the pivot pin 44.

The head is restrained in either of two or more working positions by a detent mechanism. Illustrated in FIGS. 4 and 5, the detent mechanism includes an elongate cavity in the shank at the base of the yoke, parallel to a linear axis of the handle. A detent pin 48 in the cavity is biased outward by a spring, so that it bears against a surface of the extended member 22. Two or more surfaces of the portion of the extended member which fits into the yoke have dimples 50. Dimple, as used herein, means a depression or indentation in a surface. These dimples 50 are sized and located so that they are engaged by the detent pin 48 when the head is in one of the working positions. In one or more such positions the plane of the wrench head is parallel to a linear axis of the handle; in another position the plane of the head is perpendicular to the handle. In the latter position, the wrench is more easily inserted into tight-fitting places to reach a locknut.

The yoke 46 is integral with a shank 42 at one end of the handle 40; at the other end of the handle is a grip portion for grasping. In the preferred embodiment the shank 42 is of smaller diameter than the grip portion, and the entire tool is made with relatively small dimensions for easier use in crowded work areas. The grip end of the handle is of somewhat larger diameter for a more comfortable grasp; the grip may be round or ovate in cross-section. The handle may be coated with one or more layers of insulating material both for safety and to provide a cushioned grip.

The embodiments shown and described above are only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A wrench for turning locknuts on electrical conduit, having a) a handle with a shank portion and a grip portion, b) a C-shaped head attached to said handle for engaging a locknut, c) said C-shaped head having a central portion, d) two arcuate arms integral with and extending from said central portion to form said C-shaped head, e) said arcuate arms defining a gap having a width to accept a conduit of particular diameter, wherein the improvement comprises:

f) an arcuate inner surface of said C-shaped head having a step recessed therein, g) said step having a radius to accommodate a particular size locknut, h) said step for engaging an outer perimeter of the locknut to hold said wrench in engagement with the locknut, j) each arcuate arm having a notch therein to accommodate a locknut lug, each notch having a width to accommodate either six-lug or eight-lug locknuts, and k) a shoulder adjacent each notch to engage a lug on a locknut, said shoulders being spaced apart to fit either six-lug or eight-lug locknuts, and l) said shoulder includes a recess in an inner arcuate surface thereof, said recess to receive projections from a locknut lug to ensure an improved purchase between said wrench and the locknut.

* * * * *